United States Patent [19]

Kühnis et al.

[11] Patent Number: 4,535,709

[45] Date of Patent: Aug. 20, 1985

[54] SWITCHABLE BRAKING MECHANISM, ESPECIALLY FOR THE INDIVIDUAL THREADS OF AN EMBROIDERY MACHINE

[75] Inventors: Ernst Kühnis; Armin Kobler, both of Oberriet; Max Schreiber, Arbon; Hans Wallimann, Goldach, all of Switzerland

[73] Assignee: Aktiengesellschaft Adolph Saurer, Arbon, Switzerland

[21] Appl. No.: 616,716

[22] Filed: Jun. 4, 1984

[30] Foreign Application Priority Data

Jun. 16, 1983 [CH] Switzerland ..... 3307/83

[51] Int. Cl.[3] ..... D05C 3/04

[52] U.S. Cl. ..... 112/83; 112/97; 112/89; 112/254; 112/221

[58] Field of Search ..... 112/98, 99, 100, 101, 112/96, 97, 83, 93, 89, 221, 254, 255

[56] References Cited

U.S. PATENT DOCUMENTS

| | | | |
|---|---|---|---|
| 322,860 | 7/1885 | Sabotka | 112/83 |
| 331,953 | 12/1885 | Ebmeter | 112/83 |
| 920,233 | 5/1909 | Zahn | 112/97 |
| 1,008,650 | 11/1911 | Kobler | 112/97 |
| 1,031,936 | 7/1912 | Keller | 112/97 |

FOREIGN PATENT DOCUMENTS

| | | | |
|---|---|---|---|
| 71902 | 7/1915 | Switzerland | 112/96 |

*Primary Examiner*—H. Hampton Hunter
*Attorney, Agent, or Firm*—Werner W. Kleeman

[57] ABSTRACT

The needle of an individual embroidery location of a multitude or row of linearly arranged embroidery locations in an embroidery machine is mounted at an axially displaceably guided needle carrier. According to a programmed control and by means of a related switching lever the needle can be individually coupled to or decoupled from an oscillating drive rail which is common to all the needles of the row. A thread guiding roller which is journaled for free rotation at a roller supporting lever and associated with a related one of the needles supplies a thread to the related needle. Simultaneously with the coupling or decoupling of the needle to the oscillating drive rail the roller supporting lever is pivoted between an operative position and an inoperative position in which the thread guiding roller is respectively coupled to or decoupled from a braking member which is common to all embroidery locations. The driving connection arrangement between the thread guiding roller and the common braking member is designed to act in the manner of a reducing gear, so that a rotary movement of the thread guiding roller causes a significantly less extensive rotary movement of the common braking member. The pivoting of the roller supporting lever is effected via a connecting member which may constitute a cord or a wire and which is connected to the switching lever which activates or deactivates the related embroidery location.

17 Claims, 4 Drawing Figures

SWITCHABLE BRAKING MECHANISM, ESPECIALLY FOR THE INDIVIDUAL THREADS OF AN EMBROIDERY MACHINE

BACKGROUND OF THE INVENTION

The present invention relates to a new and improved switchable braking mechanism for braking an individual thread or the like at a related embroidery location in an embroidery machine.

In its more particular aspects, the present invention relates specifically to a new and improved switchable braking mechanism for braking an individual thread at a related embroidery location in an embroidery machine which comprises a linear arrangement or row of embroidery locations. The individual threads extend to related needles and the needles of one row are mounted at a displaceably guided needle carrier. The needles are automatically and individually adjustable by means of related levers between a working position and a rest position in accordance with a programmed control of the embroidery machine. A thread guiding roller is freely rotatably journaled at a roller supporting lever and supplies the thread to the needle operatively associated therewith. Simultaneously with the adjustment of the levers which act on individual needles the related roller supporting levers are pivoted between an operative position and an inoperative position in which the thread guiding rollers are respectively coupled to or decoupled from a common braking member.

It is known to centrally brake the threads of the working needles in order to generate the necessary tension of the threads by means of a brake roller which is common to all embroidery locations of one row of embroidery locations. It is achieved thereby that the advance of the threads is the same at each one of the working or active embroidery locations, particularly independent of the material friction, the tension of the thread between the common brake roller and the bobbin and other possible unequal or irregular conditions at the different individual embroidery locations. Such equal advance of the threads, furthermore, results in an essentially uniform embroidery pattern over all working or active embroidery locations.

There are also known older designs of braking mechanisms in which the threads are wound one or more times around a common brake shaft in order to achieve the braking action. If desired, the common brake shaft can be provided with a friction-increasing cover or lining. Such designs have the disadvantage that the threads which are associated with non-working or deactivated embroidery locations must be disengaged from the common braking shaft. Otherwise such threads would be further supplied in conjunction with the threads of the working or active embroidery locations, but would not be consumed or used. Also, in case of a change in the repeat the threads of previously non-working or deactivated embroidery locations which are re-activated have to be "threaded" again or re-introduced into the related needles. Such operations are complicated and time-consuming.

In more recent constructions of embroidery machines which are provided with so-called color and repeat changing mechanisms selected combinations of working or active and non-working or inactive needles can be switched into their desired positions by the control of the embroidery machine. However, in such embroidery machines the aforementioned thread braking systems can not be employed since, then, the threads would be continuously supplied also to the non-embroidering needles.

To alleviate the aforementioned disadvantages it is known from earlier patents, for example, Swiss Pat. Nos. 28,341, 73,779 and 104,305, to freely rotatably arrange thread guiding rollers at related pivotable roller supporting levers and to associate each one of such thread guiding rollers with a related one of the needles. By pivoting the roller supporting lever the related thread guiding roller can be coupled to in a force- or form-locking manner and decoupled from a common brake shaft, depending upon whether the associated needle is working or at rest. In the arrangement according to the aforementioned Swiss Pat. No. 73,779 each needle in each color and repeat change has to be separately switched into the working or rest position according to the new repeat. In further separate operational steps also the related thread guiding rollers must be individually brought into their corresponding position by pivoting the related roller supporting lever.

In the designs according to the aforementioned Swiss Pat. Nos. 28,341 and 104,305 this time-consuming operation, in the event of a color and/or repeat change, is facilitated by supporting all roller supporting levers at a common adjustment shaft and permitting the same to be selectively connected to the common adjustment shaft for rotation by means of adjustable cams, latches or other similar elements. In this manner, even if by performing a troublesome or time-consuming operation, a distinct combination can be "programmed" so that, by pivoting the adjustment shaft, a number of thread guiding rollers can be simultaneously decoupled from or coupled to the common brake shaft and vice versa. Each time, however, such operation always permits only a single repeat change during which also in this arrangement the needles and the thread guiding rollers have to be "switched" separate from each other.

In case of embroideries which require more frequent repeat and/or color changes the older known arrangements are not only prone to malfunction, but also result in extended downtimes of the embroidery machine due to the frequent and time-consuming switching operations.

Such expense and effort for adjusting the thread guiding rollers is avoided in the arrangement according to Swiss Pat. No. 470,514. In this arrangement the working or active embroidery locations slippingly bring up or draw the required thread length around a stationary brake roller which is provided with friction pads. The thread tension which is generated in this manner can be altered for the entirety of the threads by altering the extent by which the threads are wound up on the braking roller. However, by the use of such so-called slip-tensioning devices high thread tensions cannot be generated. Particularly, it is impossible, using these known arrangements, to block any further advance of the threads. Above all, the specific advantage of the common braking shaft is abandoned by the use of a slip-tension arrangement, namely the advantage of constantly pre-braking all the threads which run at the common braking shaft and thereby ensuring for uniformity of the tension exerted on the different threads. When, however, the individual working or active embroidery locations no longer receive the same amount of the forwardly supplied or advanced threads, but instead receive an amount of thread depending upon the tension of the rearwardly supplied threads, significant differences will result in the produced embroidery from one embroidery location to the other.

Switchable braking mechanisms as known, for example, from Swiss Pat. Nos. 515,372, 535,313 and 616,715, avoid the aforementioned disadvantages in that the rollers which supply threads to the related needles are coupled to or decoupled from the common brake shaft simultaneously with the respective activation and deactivation of the individual embroidery locations.

According to the aforementioned Swiss Pat. No. 515,372 there is provided for this purpose a lever supporting a thread guiding roller and provided with a control arm cooperating with a switching shaft which switches all such levers. The switching shaft is provided in addition to a control shaft acting on the needle bars or rods and is synchronously driven therewith.

In the switchable braking mechanisms according to the aforementioned Swiss Patent Nos. 535,313 and 616,715, an expensive lever or linkage transmission replaces a programmed storage arrangement which takes the form of a control roller or switching roller and which is specifically provided to control the roller supporting levers. By means of the lever or linkage transmission the related thread guiding rollers are coupled to and decoupled from the common brake shaft via the programmed storage arrangement which activates or deactivates the needles at the individual embroidery locations.

The aforementioned known designs have in common the serious deficiency that they possess a large inert mass. Since the threads must be drawn up by the related needle during each stitch for the formation of the loop, the entire system comprising the brake shaft and the thread guiding rollers has to be jerkily incrementally rotated each time by the threads depending on the thread requirements in the known arrangement. Due to currently used high rotational speeds such kind of rotation results in impermissibly high tension peaks in the forwardly supplied threads which actually may make impossible the production of an embroidery of repeats in which only relatively few embroidery locations like, for example, only each sixth embroidery location are working or active at the same time. The reason therefore is that, in view of the small number of threads, the mass which must be jerkily moved by each thread becomes too large.

A further disadvantage inherent in the known systems is the constructionally expensive switching mechanism for engaging and disengaging the individual thread brakes.

SUMMARY OF THE INVENTION

Therefore, with a foregoing in mind it is a primary object of the present invention to provide a new and improved switchable braking mechanism for braking an individual thread at a related embroidery location in an embroidery machine which maintains the advantages of the known designs, particularly the possibility of a centrally braked to blockable thread supply and the utilization of the control for the activation and deactivation of the individual needles also for controlling related thread braking elements and which comprises a constructionally very simple switching mechanism.

Another important object of the present invention is directed to the provision of a new and improved switchable braking mechanism for braking an individual thread at a related embroidery location in an embroidery machine which, in addition to its structural simplicity, requires only a small force for its actuation.

Another very important object of the present invention is directed to the provision of a switchable braking mechanism for braking an individual thread at a related embroidery location in an embroidery machine wherein the moving parts of the braking mechanism required for the thread supply in their entirety have only low inertia.

Still, a further significant object of the present invention is to provide a new and improved switchable braking mechanism for braking an individual thread at a related embroidery location in an embroidery machine in which the moveable parts required for the thread supply in their entirety possess only a small inertia, and thus, generate only low thread tension peaks even at high embroidering speeds.

Now in order to implement these and still further objects of the invention, which will become more readily apparent as the description proceeds, the switchable braking mechanism of the present development is manifested by the features that, the driving connection arrangement between the thread guiding roller and the common braking member is structured in the manner of a reducing gear for each one of the thread guiding rollers which is coupled to the common braking member. In this driving connection arrangement the roller supporting lever is pivoted by means of a cord or wire connecting member extending to a switching lever which activates or deactivates the related embroidery location.

The use of components having the smallest possible weight and the use of bearings with the lowest possible friction contribute to the achievement of the smallest possible inert mass. However, a decisive step of this development is the design of the connection for switching the thread braking mechanism which immediately extends from the elements or members for engaging and disengaging the related needles. Such connection not only is of unique simplicity but also enables an optimum arrangement of the thread braking mechanism with respect to its operation and function. Since the driving connection arrangement between the thread guiding roller and the common braking member is structured in the manner of a reducing gear, the rotary movement of the thread guiding rollers associated with working or engaged needles and which is caused by bringing up or drawing up the required thread length, is considerably greater than the rotary movement of the continuous common braking member which is caused thereby. Specifically, there is thus obtained a very large reduction of the moment of inertia of the entire braking mechanism in its relation to each coupled thread guiding roller. Even in case of an embroidering process employing only a small number of working or active embroidery locations the tension peaks occurring at the withdrawn thread no longer assume too high values.

The driving connection between the roller supporting lever and the switching lever for activating or deactivating the related embroidery location can be designed as a connecting member responsive to tension and compression or thrust, for example, in the form of a wire or the like. The connection can also be designed as a pure tension-responsive connecting member, for example, in the form of a thin filament, a cord or the like. Advantageously, the connecting member acts upon the roller supporting lever with one of its ends and is mounted or secured with its other end to an arm of its related switching lever which upon pivoting engages or activates and disengages or deactivates the needle at the related embroidery location.

When the aforementioned connecting member, by means of which the driving connection between the thread guiding roller and the common braking member can be annihilated or discontinued, forms a pure tension-responsive connecting member, care must be taken to insure that, when the connecting member is untensioned or relieved, the related thread guiding roller automatically recouples to the common braking member. For this purpose there can be particularly utilized the dead or inherent weight of the lever-roller-arrangement. There may also be utilized the thread tension of the thread which is guided at the thread guiding roller.

In such arrangement additional circumferentially directed forces can occur between the thread guiding roller and the common braking member. Such additional circumferentially directed forces might result in slipping when the driving connection between the thread guiding roller and the common braking member is designed in the manner of a force-locking or frictional connection. It might also result in a skipping of the teeth when the driving connection between the thread guiding roller and the common braking member is designed in the manner of a form-locking connection. According to a further development of the switchable braking mechanism according to the invention, the formation of such additional circumferentially directed forces is avoided by arranging the thread guiding roller relative to the common braking member such that the resultant of the traction force acting on the thread as it is guided at the thread guiding roller extends at least approximately through the axis of the common braking member.

In an advantageous further development of the switchable braking mechanism according to the invention the roller supporting lever is supported at a stop or abutment in the position in which it is coupled to the common brake shaft. A further reduction of the inert mass is thereby obtained since the weight of the common braking member can be reduced. The stop prevents the transmission of radial forces from the thread guiding roller to the common braking member, and thus, the action of a bending load on the latter.

According to a beneficial design of the switchable braking mechanism according to the invention the roller supporting lever is designed as a one-armed lever and actuatable via an intermediate lever which is acted upon by the cord or wire connecting member. Such a construction has the advantage that in case manipulations are required at the switchable braking mechanism, only the roller supporting lever must be pivoted through a larger pivoting angle without such pivoting resulting in undue sagging of the flexible tension member.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
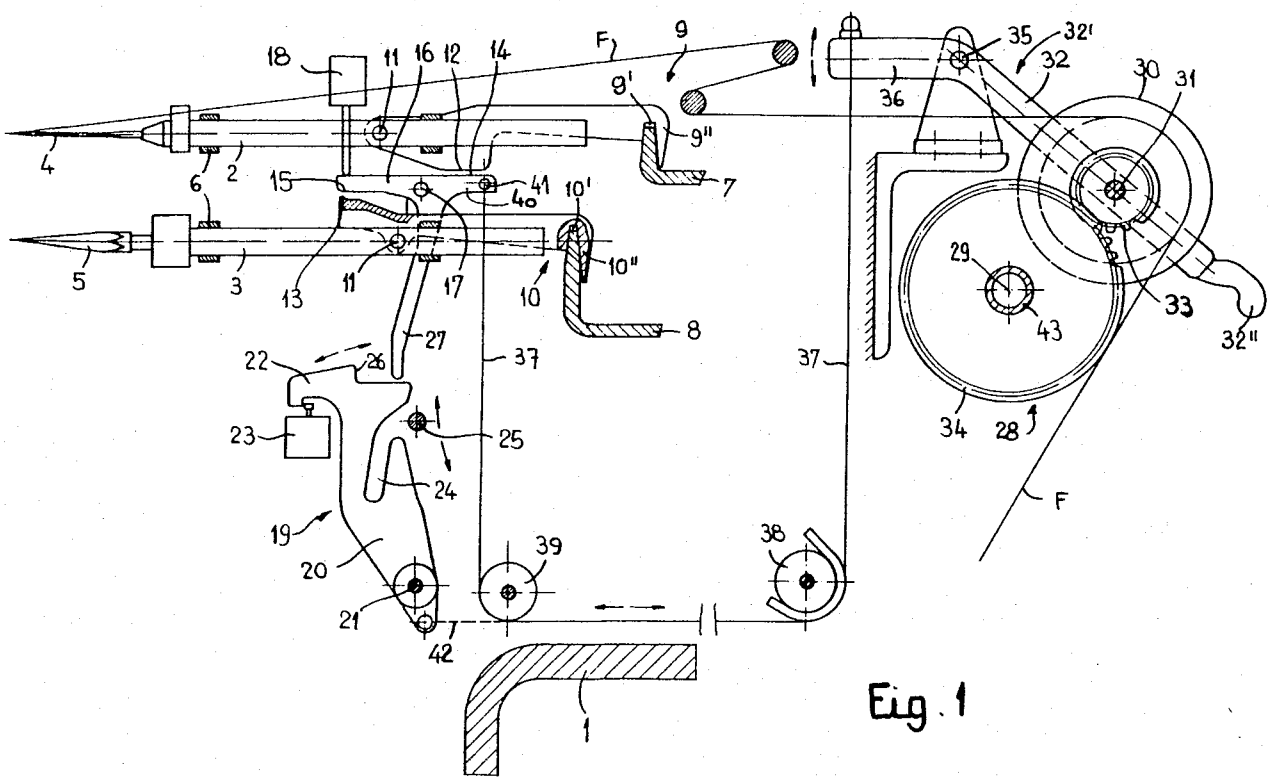
FIG. 1 is a schematic vertical section through a row of embroidery implements at an embroidery location of an embroidery machine which is provided with a first embodiment of the switchable braking mechanism according to the invention and incorporates a switching mechanism for the needle and for the braking mechanism.

Describing now the drawings, it is to be understood that only enough of the construction of the switchable braking mechanism and its related embroidery machine has been shown as needed for those skilled in the art to readily understand the underlying principles and concepts of the present development, while simplifying the showing of the drawings. Turning attention now specifically to FIG. 1 of the drawings, there has been schematically illustrated in a sectional view an embroidery location of an embroidery machine and which is one of a multitude of such embroidery locations. Depending upon the type of embroidery machine up to one thousand similar embroidery locations can be provided in a linear arrangement or row and are mounted at the machine frame which is merely indicated in FIG. 1 by the profile or frame portion 1. In the illustrated embodiment each embroidery location comprises two embroidery implement carriers 2 and 3 which support different embroidery implements as, for example, a needle 4 and a borer 5. These embroidery implement carriers 2, 3 are axially displaceably guided in guiding elements 6. The needle carrier 2 is operated by means of a drive rail 7 for the needles 4 and the borer carrier 3 is operated by means of a drive rail 8 for the borers 5. The drive rails 7, 8 extend over the entire machine length and can be displaced in transverse direction so as to perform an oscillating to-and-fro motion in a conventional and therefore here not further described manner.

The elements which cause the needle carriers 2 to be disengaged or decoupled from and engaged or coupled to the drive rail 7 and the borer carriers 3 to be disengaged or decoupled from and engaged or coupled to the drive rail 8 encompass a pawl or latch member 9 and 10, respectively. With one of their ends these pawls or latch members 9 and 10 are hinged to the related carrier 7 and 8 by means of a pivot pin or plug 11. At their related free ends the pawls or latch members 9 and 10 are each provided with a respective downwardly open groove 9' and 10' for engaging over a related nose 9'' and 10'' at the related drive rails 7 and 8. By means of conventional springs or equivalent structure which are not particularly illustrated, the pawls or latch members 9 and 10 are biased at their respective carriers 2 and 3 in the direction of their related engaging or coupling position. The carriers or carrier members 2 and 3 can be disengaged or decoupled from their related drive rails 7 and 8 by lifting or elevating the pawl or latch members 9 and 10 against the action of the related springs. For this purpose, the pawls or latch members 9 and 10 are provided at their respective lower and upper sides with a related control or cam surface 12 and 13 which cooperates with a related control or cam surface 14 and 15 at a switching lever 16. Significant in this regard are, for instance, U.S. Pat. Nos. 4,426,941, granted Jan. 24, 1984, and 4,434,728, granted Mar. 6, 1984.

The switching lever 16 is pivotably supported for pivoting about a pivot pin or lug 17 between two end or terminal positions. In this arrangement a related switching lever 16 is provided for each one of the embroidery locations. The switching lever 16 simultaneously engages or couples the embroidery implement carriers 2 and 3 to the related drive rails 7 and 8 or simultaneously disengages or decouples the same therefrom. When the switching lever 16 is pivoted in an anti-clockwise direction from the position as illustrated in FIG. 1, the pawls or latch members 9 and 10 are decouplingly lifted from the related drive rails 7 and 8. Conversely, the embroidery implement carriers 2 and 3 are re-engaged or recoupled to the related drive rails 7 and 8 upon repivoting the switching lever 16 into the illustrated position.

The actuation of the switching lever 16 for engaging or disengaging the embroidery implements 4 and 5 at the related embroidery location may be manually performed by means of a manual adjustment device 18 which directly acts upon an arm of the switching lever 16. The actuation of the switching lever 16 for engaging or disengaging the embroidery implements 4, 5 at the related embroidery location may also be automatically effected by the embroidery machine control via an adjusting means which is generally designated by the reference character 19.

In the illustrated embodiment the adjusting means 19 at each embroidery location encompasses a pawl or latching lever 20 which is pivotable about a pivot pin or plug 21, an electromagnet 23 cooperating with a switching arm 22 of the pawl or latching lever 20, and a switching rod or bar 25 which cooperates with a positioning or adjustment slot 24 in the pawl or latching lever 20. After release by the electromagnet 23 the related pawl or latching lever 20 is pivoted about the pivot pin or plug 21. The switching rod or bar 25 thus enters the positioning or adjustment slot 24 and thereby causes the switching lever 16 to be pivoted from the illustrated one end position and to be positioned into the other end position. As recognizable from FIG. 1, an actuation nose 26 of the pawl or latching lever 20, during the pivoting motion thereof, interacts with a positioning arm 27 of the switching lever 16.

At the same time at which the embroidery implement at an individual embroidery location is engaged or activated or, respectively, disengaged or deactivated by the pivoting motion of the switching lever 16, the related thread guiding roller 30, which supplies a related thread F to the related needle 4 at the embroidery location, either is displaced into a working or operative position or into a rest or inoperative position. The thread guiding roller 30 is journaled for free rotation about a pivot pin or plug 31 at a first arm 32 of a roller supporting lever 32' which constitutes an angled lever. The thread guiding roller 30 is further provided with a pinion 33 such that the pinion 33 is fixed against rotation relative to the thread guiding roller 30. In FIG. 1 of the drawings the thread guiding roller 30 is shown in its working or operative position in which the pinion 33 thereof meshes with the teeth of a toothed disk or plate 34. This toothed disk or plate 34 preferably comprises a plastic gear wheel or gear which is fixedly connected to a shaft 43 so as to be non-rotatable relative thereto. Further such toothed disks or plates 34 are arranged or mounted at the shaft 43 and each one thereof is operatively associated with the related thread guiding roller 30 of a related embroidery location of the row of embroidery locations. In their entirety the shaft 43 and the toothed disks or plates 34 secured thereto constitute a common braking member 28 which is common for all the thread guiding rollers 30 of a row of embroidery locations in the embroidery machine and the common braking member is generally designated by the reference character 28.

In the working or operative position of the thread guiding roller 30 which is illustrated in FIG. 1, the related needle 4 is also engaged or coupled to the drive rail 7 by means of the related carrier 2. The thread guiding roller 30 must be switched into a rest or inoperative position when the related embroidery location is non-working or inactive. For this purpose the form-locking driving connection between the thread guiding roller 30 and the common braking member 28 must be released, so that the pinion 33 of the thread guiding roller 30 is lifted off from the associated toothed disk or plate 34 of the common braking member 28 in order to prevent that the thread F is still further supplied to the then resting or disengaged needle 4 in correspondence with the rotary motion of the common braking member 28.

For this purpose the roller supporting lever 32' supporting the thread guiding roller 30 is mounted for pivoting about a pivot pin or plug 35. A flexible connecting member 37 which here has the form of a thin cord, for example, of a monofil thread, acts upon a second arm 36 of the roller supporting lever 32'. The second arm 36 is connected at location 41 with one arm 40 of the switching lever 16 and, if desired and depending on the requirements, the connecting member 37 can be guided at deflecting rollers 38 and 39. The switching lever 16 may be pivoted in counterclockwise direction either by means of the manual adjusting device 18 or by the automatic adjusting means 19 in order to disengage or decouple the needle 4 from the drive rail 7. During the pivoting movement of the switching lever 16 the roller supporting lever 32' is also pivoted in counterclockwise direction via the connecting member 37. The thread guiding roller 30 is thereby lifted off from the common braking member 28, and thus, the driving connection between the thread guiding roller 30 and the common braking member 28 is released or disconnected.

The tension-responsive connecting member 37, instead of directly acting on the switching lever 16, may also act upon the pawl or latching lever 20 of the automatic adjusting means 19 as indicated by the broken line 42 in FIG. 1. Simultaneous switching of the braking mechanism and the needle 4 at the related embroidery location, then, is only effected during automatic operation but is not effected when the switching lever 16 is actuated by means of the manual adjusting device 18.

It will be self-evident that the pivot axis defined by the pivot pin 35 of the roller supporting lever 32' as well as the pivotal or engaging points of the tension-responsive connecting element 37 at the roller supporting lever 32' and at the switching lever 16 or the pawl or latching lever 20 can be selected such that the roller supporting lever 32' is pivoted due to the switching motion to such an extent that the driving connection between the pinion 33 of the thread guiding roller 30 and the related toothed disk or plate 34 mounted at the shaft 43 is reliably or positively released or disconnected.

As further evident from FIG. 1, the thread guiding arrangement and the thread guiding roller 30 are arranged in such a manner that the resultant of the thread tension force exerted on the thread guiding roller 30 by the thread F, when the thread guiding roller 30 is coupled or engaged to the common braking member 28, extends through the axis 29 of the common braking member 28 in order to prevent the occurrence of undesired circumferentially directed forces between the thread guiding roller 30 and the common braking member 28. Furthermore, as also recognizable from FIG. 1, the pivoting point or fulcrum formed by the pivot pin or plug 35 of the angled lever forming the roller supporting lever 32′ is arranged such that the lift-off of the pinion 33 from the teeth of the related toothed disk or plate 34 is effected along a radial direction defined by the common braking member 28. By such arrangement it can be avoided that forces result from the thread tension and the braking action of the common braking member 28 and which could cause an unintentional lift-off of the thread guiding roller 30 from the common braking member 28.

When the connecting member 37, instead of being a cord or monofil thread as employed in the heretofore described embodiment, constitutes a wire, the switching or adjusting connection between the switching lever 16 or the pawl or latching lever 20 for engaging or coupling and disengaging or decoupling the needle 4 and the roller supporting lever 32′ forms a connection which is responsive to tension and compression. With such type of connection not only the lift-off of the thread guiding roller 30 from the common braking member 28, but also the coupling or engagement of the thread guiding roller 30 to the common braking member 28 is positively effected by the switching mechanism which engages or couples and disengages or decouples the needle 4. Contrary thereto, when the connection is solely responsive to tension, the engagement of the thread guiding roller 30 to the common braking member 28, in the relieved or released state of the connecting or tension-responsive member 37, is automatically effected under the action of gravity and also by the tension of the thread F.

The thread guiding roller 30 may be unintentionally pressed against the common braking member 28, for example, when the braking mechanism is manually actuated via the handle, which is indicated at 32″, located at the end of the first arm 32 of the roller supporting lever 32′ in FIG. 1. In order to prevent the forces transmitted by the connecting member 37 during such unintentional pressing motion of the thread guiding roller 30 from producing damage, particularly deformation of the switching lever 16 or the pawl or latching lever 20, the end of the connecting member 37 can be advantageously anchored at the roller supporting lever 32′ via a spring 45 of the type which is illustrated with respect to the second embodiment of the switchable braking mechanism in FIG. 2. This spring 45 is dimensioned such that the actuation of the roller supporting lever 32′ by means of the switching lever 16 or the pawl or latching lever 20 through the connecting member 37 is reliably ensured for, but any loads in excess thereof are absorbed by the spring 45.

As already initially mentioned great importance is attributed to the feature that the driving connection arrangement between the thread guiding roller or roll 30 and the common braking member 28 is designed in the manner of a reducing gear. The rotation of the thread guiding roller 30 due to the thread consumption by the working or active needle 4 thus causes significantly less rotation of the common braking member 28. This is true for the design of the driving connection arrangement as shown for the presently described embodiment which forms a positive or form-locking connection between the pinion 33 and the toothed disk or plate 34. It is also true for a force-locking driving connection which can also be utilized and may have the form of a frictional driving connection, for example, between friction rollers which replace the pinion 33 and the toothed disk or plate 34.

Figure 2:
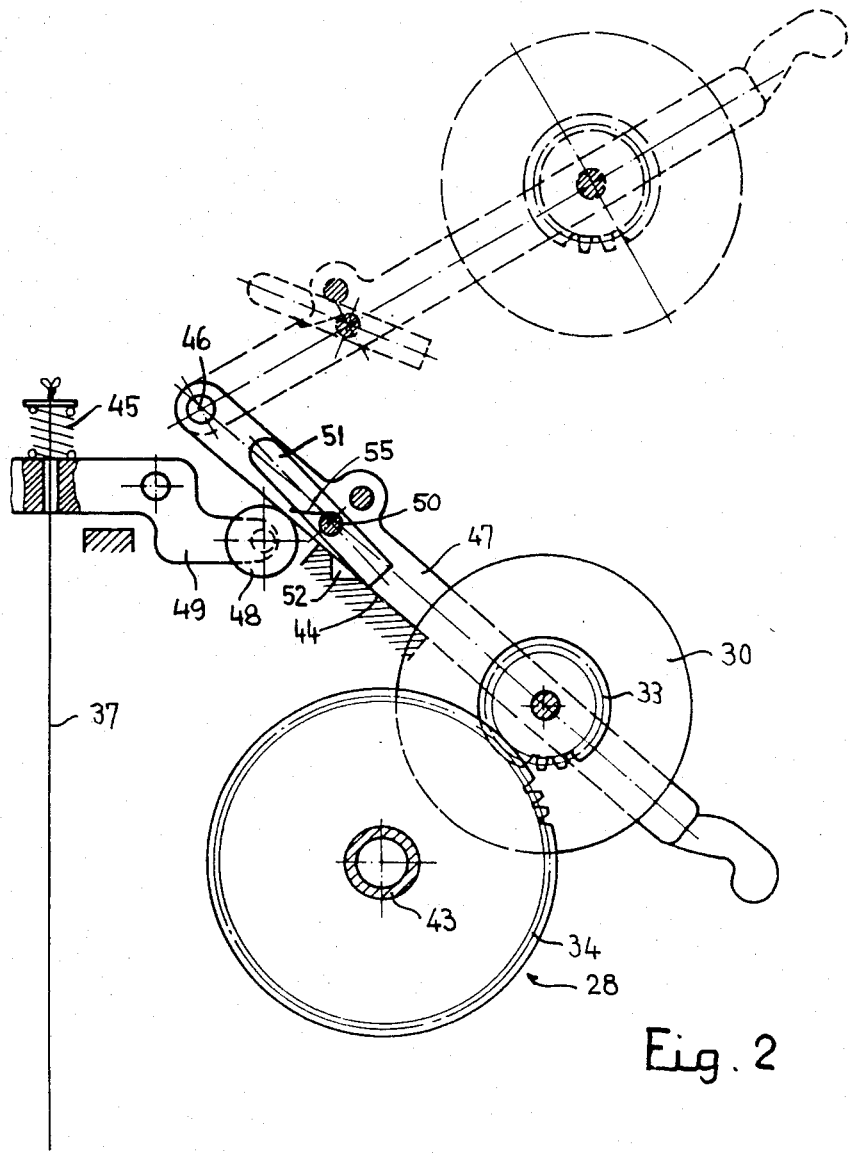
FIG. 2 shows at a larger scale a second embodiment of the switchable braking mechanism according to the invention.

Not only the individual toothed disks or plate 34 but also the continuous shaft 43 should be constructed as light-weight as possible, in order to obtain the smallest possible inert mass of the moving components during the working or operation of the switchable braking mechanism. The radial load on this shaft 43 which is due to the engaged or coupled thread guiding rollers 30 of a row of embroidery locations in an embroidery machine results in bending forces which hitherto have required a heavy-weight construction of the shaft 43. In order to be able to arrive at a more light-weight mode of construction of the shaft 43 by relieving this shaft 43 from the aforementioned bending forces as well as by passing on the torsion forces caused by the braking action, a stop 44 or abutment is arranged at the machine frame as shown in FIG. 2. When the braking mechanism is operative or engaged, the roller supporting lever 32′ bears upon the stop 44 in such a manner that a slight radial play is maintained in the engagement of the teeth of the pinion 33 and the related toothed disk or plate 34. No direct radial forces but only circumferentially directed forces are thus transmitted through the interengaged gear teeth to the common braking member 28. Additionally, the danger of jamming of the teeth is counteracted by these measures. Such stop 44 is omitted in the drawing of FIG. 1, however, it appears in the drawings of FIG. 2 to 4 showing the other embodiments and can also be readily used in conjunction with the embodiment illustrated in FIG. 1.

Further possibilities of use as well as an enhanced user-friendly operation of the switchable braking mechanism described hereinbefore result when the braking mechanism additionally can be manually turned off. Such a manual switch-off or turn-off arrangement is realized in the second embodiment of the switchable braking mechanism according to the invention illustrated in FIG. 2. The two-armed or double-armed roller supporting lever 32′ in the first embodiment shown in FIG. 1 is replaced in the second embodiment by a one-armed or single-arm roller supporting lever 47 which is pivotably mounted at a pivotal point or fulcrum 46. The one-armed roller supporting lever 47 can be lifted off from the common braking member 28 by an intermediate or second lever 49 which is provided with a roller 48 and is acted upon by the tension-responsive connecting member 37. The roller supporting lever 47 in this embodiment can be manually upwardly pivoted through a considerable pivoting range, for example, up to the position indicated by broken lines in FIG. 2. The tension-responsive connecting member 37 mounted at the intermediate lever 49 which is not affected by such pivoting of the roller supporting lever 47 can not freely sag, be disengaged from the guiding elements therefor or become entangled in the moving parts of the embroidery machine due to such pivoting movement of the roller supporting lever 47.

The roller supporting lever 47 carries a lock pawl or catch 51 which is mounted thereat for pivoting about a pivot pin or plug 50 and which conveniently is biased in clockwise direction in FIG. 2 by a spring 55. The design and arrangement of the components is selected in such a manner that, when the roller supporting lever 47 is forcefully lifted such as during manual actuation, the lock pawl or catch 51 which is then also pivoted due to its biasing spring 55 engages a notch or detent 52 at the stop or abutment 44 when the roller supporting lever 47 is released. A coupling or engagement of the thread guiding roller 30 to the common braking member 28 is thereby prevented. Contrary thereto, when the roller supporting lever 47 is slightly lifted as during the automatic decoupling or disengagement of the braking mechanism by means of the connecting member 37 and the intermediate lever 49, the pivoting motion is insufficient to permit the lock pawl or catch 51 to enter the notch or detent 52. The thread guiding roller 30, therefore, is again coupled or engaged to the common braking member 28 under the action of gravity which is assisted by the thrread tension, when the connecting member 37 is relieved. Such mode of operation naturally is also ensured when the connecting member 37 is structured as a connecting member which responds to tension and compression. Such kind of manual actuation of the braking mechanism can be utilized in analogous manner in the design of the roller supporting lever 32' of the first embodiment shown in FIG. 1. For disengaging the lock pawl or catch 51 it suffices to slightly touch the lock pawl or catch 51, whereby the thread guiding roller 30 can again couple to or engage the common braking member 28.

Figure 3:
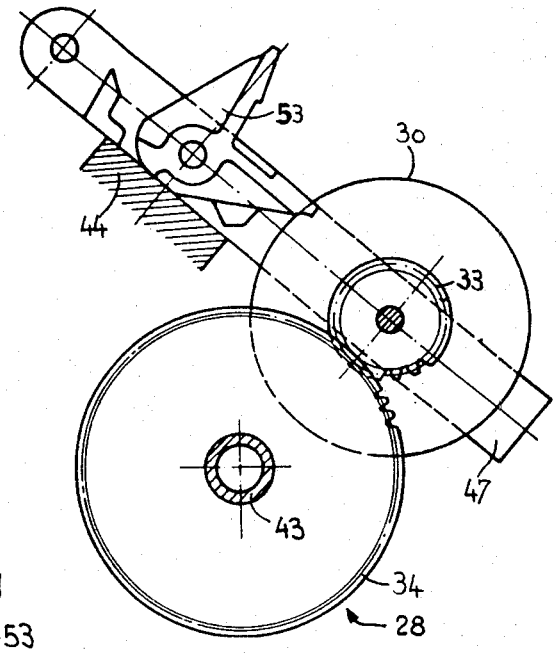
FIGS. 3 and 4 show, in a similar view to that of FIG. 2, a third embodiment of the switchable braking mechanism according to the invention in two different functional states.
Figure 4:
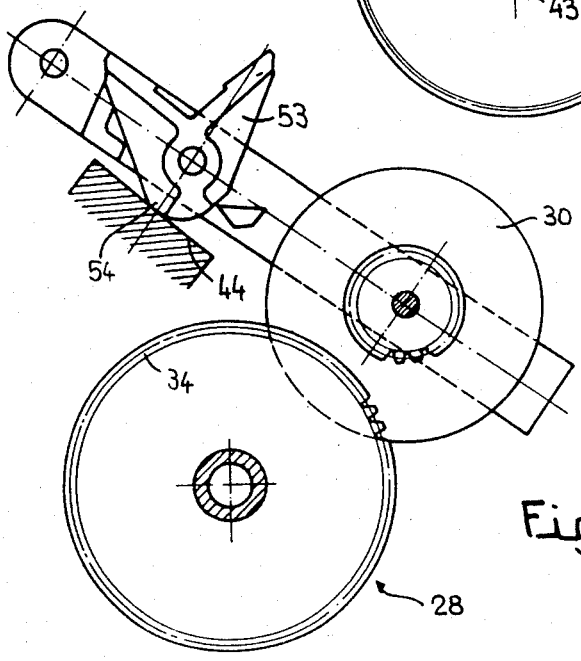

A third embodiment of the switchable braking mechanism according to the invention is shown in two functionally different positions in FIGS. 3 and 4. Differenty from the second embodiment as shown in FIG. 2 the roller supporting lever 47 in this third embodiment carries, instead of the lock pawl or catch 51, a rocker or rocker member 53 which locks in two positions mutually rotated by an angle of about 90°. In one locked end position illustrated in FIG. 3 the rocker 53 does not block recoupling or reengagement of the driving connection between the thread guiding roller 30 and the common braking member 28 after the thread guiding roller 30 has been lifted off therefrom. In the other end position illustrated in FIG. 4, contrary thereto, a nose 54 of the rocker 53 comes into engagement with the stop or abutment 44 and prevents the pinion 33 from meshing or engaging the teeth of the toothed disk or plate 34. The capability of such intentional switching can be desired in certain cases, for instance, when the thread is brought-up or drawn-up after a thread rupture.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A switchable braking mechanism for braking an individual thread supplied to the needle at a related embroidery location in an embroidery machine including a linear arrangement of such embroidery locations at each of which a related needle is mounted and operated according to a programmed control of the embroidery machine, said switchable braking mechanism comprising:

a predetermined number of switching levers;

each one of said switching levers being operatively associated with a related needle and automatically and individually adjusting the related needle into a working position or into a rest position in accordance with the programmed control of the embroidery machine;

a predetermined number of thread guiding rollers;

each one of said thread guiding rollers being operatively associated with said related needle and supplying the individual thread to said related needle;

a predetermined number of roller supporting levers;

each one of said thread guiding rollers being journaled at the related roller supporting lever for free rotation;

a common braking member;

each one of said roller supporting levers being pivotable between an operative position and an inoperative position in which each said thread guiding roller is respectively coupled to or decoupled from said common braking member;

a predetermined number of driving connection arrangements;

each said driving connection arrangement being provided between a related one of said thread guiding rollers and said common braking member and acting in the manner of a reducing gear when said related thread guiding roller is coupled to said common braking member;

a predetermined number of connecting members; and each one of said roller supporting levers being pivotable via a related one of said connecting members leading to a related one of said switching levers acting on the related needle in order to activate or deactivate the related embroidery location.

2. The switchable braking mechanism as defined in claim 1, wherein:

each one of said connecting members comprises a cord.

3. The switchable braking mechanism as defined in claim 1, wherein:

each one of said connecting members comprises a wire.

4. The switchable braking mechanism as defined in claim 1, wherein:

each one of said connecting members provides a connection which is responsive to tension as well as to compression.

5. The switchable braking mechanism as defined in claim 1, wherein:

each one of said connecting members provides a tension-responsive connection which, in response to tension, disconnects the driving connection between said related thread guiding roller and said common braking member; and said related thread guiding roller, after release of said tension, becoming automatically coupled to said common braking member.

6. The switchable braking mechanism as defined in claim 1, wherein:

each one of said switching levers is pivotable between two end positions in order to automatically and individually adjust the related needle into said working position and into said rest position thereof and to thereby respectively activate and deactivate the related embroidery location;

each said pivotable switching lever having arranged thereat a control surface and comprising an arm;

each said connecting member possessing two ends; and one of said two ends of said connecting member being secured to a related one of said roller supporting levers and the other one of said two ends of said connecting member being secured to said arm of said related switching lever.

7. The switchable braking mechanism as defined in claim 6, further including:

rollers for deflecting said connecting member and arranged forwardly of said other one of said two ends thereof.

8. The switchable braking mechanism as defined in claim 1, further including:

a predetermined number of automatic adjusting means each comprising a latching lever;

each one of said switching levers cooperating with a related one of said adjusting means and being pivotable under the action thereof in order to automatically and individually adjust the related needle into said working position and into said rest position thereof and to thereby respectively activate and deactivate the related embroidery location;

each said connecting member possessing two ends; and one of said two ends of said connecting member acting upon a related one of said roller supporting levers and the other one of said two ends of said connecting member acting upon said latching lever of a related one of said automatic adjusting means.

9. The switchable braking mechanism as defined in claim 8, further including:

rollers for deflecting said connecting member and arranged forwardly of said latching lever.

10. The switchable braking mechanism as defined in claim 1, wherein:

said common braking member defines an axis;

said individual thread, when guided about a related one of said thread guiding rollers, exerting a tension force on said related thread guiding roller; and said related thread guiding roller and said common braking member being arranged relative to each other such that the resultant of said tension force exerted by said individual thread on said related thread guiding roller at least approximately extends through said axis of said common braking member.

11. The switchable braking mechanism as defined in claim 1, wherein:

said common braking member defines a radial direction; and each said thread guiding roller, during shut-off of the switchable braking mechanism, being lifted off from said common braking member along a predetermined path extending at least approximately in said radial direction.

12. The switchable braking mechanism as defined in claim 1, further including:

at least one stationary stop;

each said roller supporting lever being supported at said at least one stationary stop in a position in which said thread guiding roller is coupled to said common braking member; and said at least one stop, when said thread guiding roller is supported thereat, preventing the transmission of radially directed forces from said thread guiding roller to said common braking member.

13. The switchable braking mechanism as defined in claim 1, wherein:

each said connecting member contains a related resilient element operatively associated thereof.

14. The switchable braking mechanism as defined in claim 1, wherein:

each said roller supporting lever comprises a two-armed lever;

a first arm of said two-armed lever supporting a related one of said thread guiding rollers; and a second arm of said two-armed lever being acted upon by a related one of said connecting members.

15. The switchable braking mechanism as defined in claim 1, further including:

a predetermined number of intermediate levers each of which is acted upon by a related one of said connecting members; and each said roller supporting lever comprising a one-armed lever which is actuatable by a related one of said intermediate levers.

16. The switchable braking mechanism as defined in claim 1, further including:

a predetermined number of lock pawls;

each said lock pawl being pivotably arranged at a related one of said roller supporting levers;

a predetermined number of detents each of which cooperates with a related one of said lock pawls; and each said detent cooperating with said related lock pawl in order to prevent, after manual disconnection of the switchable braking mechanism, recoupling of said related thread guiding roller to said common braking member after it has been released.

17. The switchable braking mechanism as defined in claim 1, further including:

a predetermined number of rocker members each of which can be locked in two end positions;

each said rocker member being supported at a related one of said roller supporting levers;

at least one stationary stop;

said at least one stationary stop cooperating with said rocker member in one of said two end positions thereof in order to prevent engagement of the switchable braking mechanism; and said rocker member permitting, in the other one of said two end positions thereof, engagement of the switchable braking mechanism.

* * * * *